US007963668B2

(12) United States Patent
Yin et al.

(10) Patent No.: US 7,963,668 B2
(45) Date of Patent: Jun. 21, 2011

(54) STREET LAMP EMITTING FILTERED LIGHT

(75) Inventors: Chih-Hsiang Yin, Taipei Hsien (TW); Ta-Hsaing Chao, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 229 days.

(21) Appl. No.: 12/331,397

(22) Filed: Dec. 9, 2008

(65) Prior Publication Data

US 2009/0231844 A1 Sep. 17, 2009

(30) Foreign Application Priority Data

Mar. 14, 2008 (CN) ..... 2008 1 0300574

(51) Int. Cl.
*F21V 5/04* (2006.01)

(52) U.S. Cl. ..... 362/244; 362/249.02; 362/311.02; 362/307; 362/2

(58) Field of Classification Search .. 362/31.02–311.15, 362/367, 805, 2, 1
See application file for complete search history.

(56) References Cited

U.S. PATENT DOCUMENTS

| | | | | |
|---|---|---|---|---|
| 6,402,347 | B1 * | 6/2002 | Maas et al. | 362/294 |
| 6,784,357 | B1 * | 8/2004 | Wang | 136/244 |
| 7,021,807 | B2 * | 4/2006 | Chew | 362/545 |
| 7,431,477 | B2 * | 10/2008 | Chou et al. | 362/240 |
| 2008/0219000 | A1 * | 9/2008 | Fan | 362/241 |

FOREIGN PATENT DOCUMENTS

| | | | |
|---|---|---|---|
| CN | 2494918 | Y | 6/2002 |
| CN | 2767815 | Y | 3/2006 |
| CN | 1921155 | A | 2/2007 |
| JP | 2007158006 | A | 6/2007 |
| TW | I282632 | | 6/2007 |

* cited by examiner

*Primary Examiner* — Robert May
(74) *Attorney, Agent, or Firm* — Zhigang Ma

(57) ABSTRACT

A street lamp includes a lampshade, a light-emitting diode array, a lens array, and a filter film. The lampshade includes a bottom wall and a sidewall extending around the bottom wall, the lampshade defines a receiving space with an opening opposite to the bottom wall. The light-emitting diode array is received in the receiving space and has a number of light-emitting diodes which light emitting direction faces to the opening of the lampshade. The lens array has a number of lenses corresponding to the light-emitting diodes, the lenses is capable of converging light emitting from the light-emitting diodes. The filter film is disposed on the optical path of the plurality of light-emitting diodes for filtering light of predetermined wavelength ranges.

17 Claims, 2 Drawing Sheets

STREET LAMP EMITTING FILTERED LIGHT

TECHNICAL FIELD

The present invention relates to lamps and, particularly, to a street lamp capable of promoting plant growth.

DESCRIPTION OF THE RELATED ART

Street lamps have been used commonly in almost every city, every town now. The street lamps are basically used for illuminating streets and roads. However, the light emitted from the street lamps may also irradiate flora in the vicinity, such as grass and trees. Typical street lamps usually emit light of various wavelengths, such as ultraviolet light, visible light, and infrared light. It is known that overexposure to ultraviolet light and infrared light may inhibit growth and may even be dangerous to flora. As a result, the light transmitting towards the plants usually cannot promote plant growth efficiently, and in addition, the energy of the street lamp is not used efficiently.

What is needed, therefore, is a street lamp capable of emitting light of predetermined wavelength range according to growth requirements of nearby flora.

BRIEF DESCRIPTION OF THE DRAWINGS

Many aspects of the present street lamp can be better understood with references to the accompanying drawings. The components in the drawings are not necessarily drawn to scale, the emphasis instead being placed upon clearly illustrating the principles of the present street lamp.

DETAILED DESCRIPTION OF THE EMBODIMENTS

Embodiments of the present disclosure will now be described in detail below, with references to the accompanying drawings.

Figure 1:
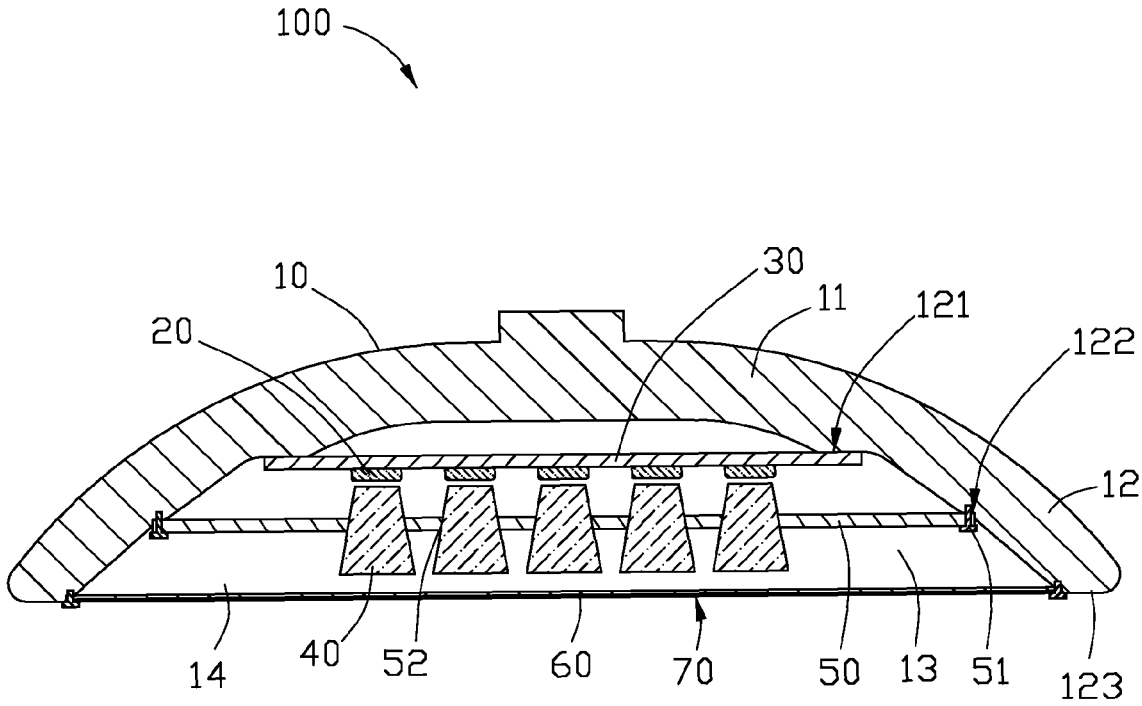
FIG. 1 is a schematic, cross-sectional view of a street lamp according to a first exemplary embodiment.

Referring to FIG. 1, a street lamp 100 according to a first exemplary embodiment is shown. The street lamp 100 includes a lampshade 10, a light-emitting diode (LED) array 20, a lamp mounting plate 30, a lens array 40, a lens mounting plate 50, a transparent cover 60, and a filter film 70.

The lampshade 10 is substantially bowl-shaped. The lampshade 10 includes a bottom wall 11 and a sidewall 12 extending around the bottom wall 11. The lampshade 10 defines a receiving space 13 with an opening 14 opposite to the bottom wall 11. The sidewall 12 has a first ring-shaped loading surface 121 and a second ring-shaped loading surface 122. The first loading surface 121 is disposed between the second loading surface 122 and the bottom wall 11, and is substantially parallel to the second loading surface 122. Both the first loading surface 121 and the second loading surface 122 face towards the opening 14.

The lamp mounting plate 30 is received in the receiving space 13 and attached to the first loading surface 121 by such as glue, screws and so on. The lamp mounting plate 30 can be circuit board capable of supplying power to the LED array 20. In the present embodiment, the lamp mounting plate 30 is attached to the first loading surface 121 by glue. Alternatively, the lamp mounting plate 30 can be directly attached to the bottom wall 11.

The LED array 20 includes a number of LEDs. The number of the LEDs included in the LED array 20 determines the brightness of the street lamp 100. In the present embodiment, the LED array 20 includes 22 LEDs, and the brightness of the lamp 100 is 70 lumens. The LED array 20 is received in the receiving space 13 and can be mounted on the lamp mounting plate 30 by glue, soldering and so on. The light emitting direction of the LED array 20 faces to the opening 14 of the lampshade 10.

The lens mounting plate 50 is also received in the receiving space 13 and attached to the second loading surface 122 by such as glue, screws and so on. In the present embodiment, the lens mounting plate 50 is fixed to the second loading surface 122 by a number of screws 51. The lens mounting plate 50 defines a number of apertures 52 corresponding to the LEDs of the LED array 20.

The lens array 40 includes a number of lenses. Each of the apertures 52 receives a lens of the lens array 40 therein for converging light emitted from a corresponding LED of the LED array 20. In the present embodiment, the lens array 40 has 22 lenses, and the lens mounting plate 50 has 22 apertures 52 for receiving the lenses, respectively.

The transparent cover 60 is attached to the free end 123 of the sidewall 12 of the lampshade 10 and covers the opening 14 to protect the LED array 20 and the lens array 40 received in the receiving space 13. The transparent cover 60 can be fixed to the free end 123 of the sidewall 12 by glue, screws and so on. In the present embodiment, the transparent cover 60 is fixed to the free end 123 by a number of screws. The transparent cover 60 can be made from glass or plastic.

The filter film 70 is configured for transmitting light of predetermined wavelength range. The filter film 70 can be formed on the lenses of the lens array 40 or the transparent cover 60. In the present embodiment, the filter film 70 is formed on a surface of the transparent cover 60 facing away from the LED array 20. According to the type of flora near to the street lamp 100, the transparent cover 60 can be fitted with a selected filter film 70. In the present embodiment, only light in the wavelength range from 400 nm to 520 nm can be transmitted through the filter film 70, which is a known range that promotes photosynthesis in most floras.

Figure 2:
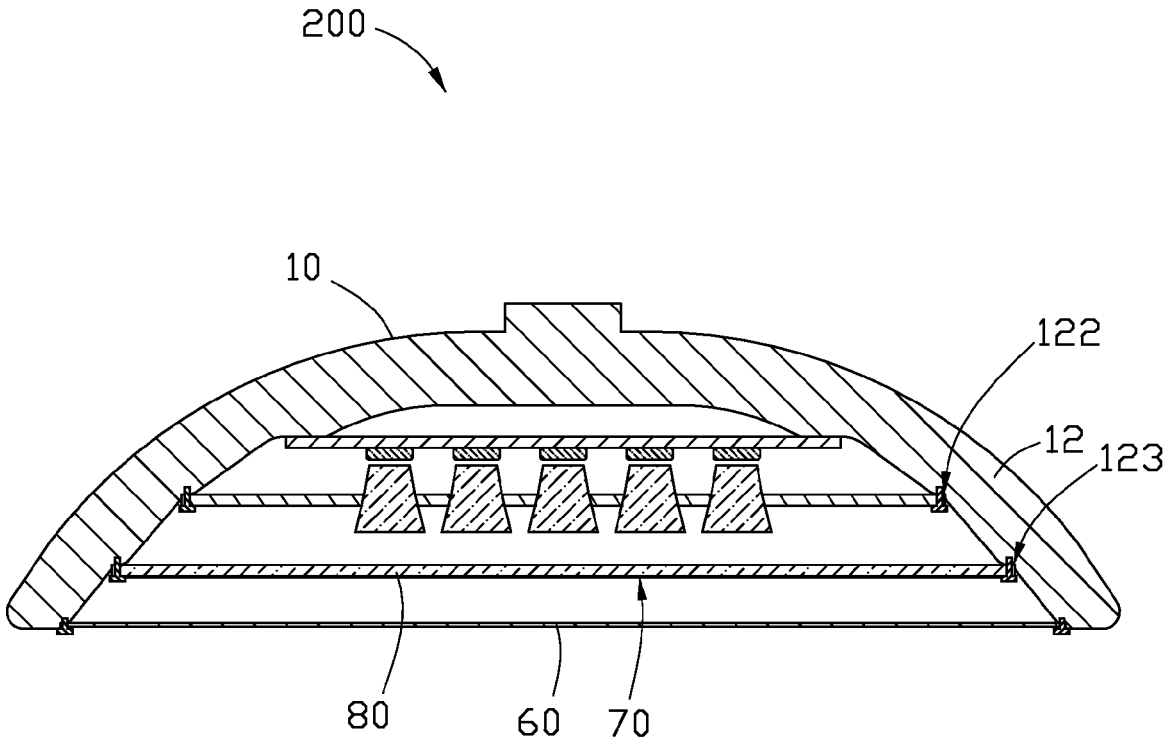
FIG. 2 is a schematic, cross-sectional view of a street lamp according to a second exemplary embodiment.

Referring to FIG. 2, a street lamp 200 according to a second exemplary embodiment is shown. The street lamp 200 is similar to the street lamp 100 of the first exemplary embodiment. The difference between the street lamp 200 and the street lamp 100 is that, in the street lamp 200, the sidewall 12 of the lampshade 10 further includes a third ring-shaped loading surface 123 disposed between the second loading surface 122 and the transparent cover 60. A filter plate 80 is attached to the third loading surface 123. The filter film 70 is formed on the filter plate 80.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. A street lamp comprising:

a lampshade comprising a bottom wall and a sidewall extending around the bottom wall, the lampshade defining a receiving space with an opening opposite to the bottom wall;

a light-emitting diode array received in the receiving space, the light-emitting diode array having a plurality of light-emitting diodes whose light emitting direction faces the opening of the lampshade;

a lens array having a plurality of lenses corresponding to the plurality of light-emitting diodes, the plurality of lenses capable of converging light emitted from the plurality of light-emitting diodes, a lens mounting plate fixed to the sidewall of the lampshade, the lens mounting plate comprising a plurality of apertures corresponding to the plurality of light-emitting diodes of the light-emitting diode array, each of the apertures receiving a lens of the lens array; and a filter film disposed in the optical path of the plurality of light-emitting diodes for filtering light of predetermined wavelength ranges to correspond with needs of flora in the path of light emitted by the street lamp.

2. The street lamp as claimed in claim 1, further comprising a lamp mounting plate fixed to the bottom wall or the sidewall of the lampshade, the light-emitting diode array being mounted on the lamp mounting plate.

3. The street lamp as claimed in claim 2, wherein the lampshade comprises a first ring-shaped loading surface facing the opening, the lamp mounting plate is attached to the first loading surface.

4. The street lamp as claimed in claim 1, wherein the lampshade comprising a ring-shaped loading surface facing to the opening, the lens mounting plate is attached to the second loading surface.

5. The street lamp as claimed in claim 1, further comprising a transparent cover attached to the free end of the sidewall of the lampshade, the transparent cover covering the opening of the lampshade to protect the light-emitting diode array and the lens array received in the receiving space.

6. The street lamp as claimed in claim 5, wherein the filter film is formed on the transparent cover.

7. The street lamp as claimed in claim 5, further comprising a filter plate disposed between the lens array and the transparent cover, and the filter film being formed on the filter plate.

8. The street lamp as claimed in claim 1, wherein the filter film is formed on the plurality of lenses of the lens array.

9. A street lamp comprising:

a lampshade defining a receiving space with an opening;

a plurality of light-emitting diodes received in the receiving space for emitting light towards the opening of the lampshade;

a plurality of lens received in the receiving space corresponding to the plurality of light-emitting diodes, the plurality of lenses capable of converging light emitted from the plurality of light-emitting diodes, a lens mounting plate fixed to the sidewall of the lampshade, the lens mounting plate comprising a plurality of apertures corresponding to the plurality of light-emitting diodes, each of the apertures receiving a lens of the plurality of lens; and a filter film disposed in the optical path of the plurality of light-emitting diodes for filtering light of predetermined wavelength ranges.

10. The street lamp as claimed in claim 9, wherein the lampshade comprises a bottom wall opposite to the opening of the lampshade and a sidewall extending around the bottom wall.

11. The street lamp as claimed in claim 10, further comprising a transparent cover attached to the free end of the sidewall of the lampshade, the transparent cover covering the opening of the lampshade to protect the plurality of light-emitting diode and the plurality of lens array received in the receiving space.

12. The street lamp as claimed in claim 11, wherein the filter film is formed on the transparent cover.

13. The street lamp as claimed in claim 11, further comprising a filter plate disposed between the plurality of lens and the transparent cover, and the filter film being formed on the filter plate.

14. The street lamp as claimed in claim 9, wherein the lampshade comprises a bottom wall opposite to the opening of the lampshade and a sidewall extending around the bottom wall.

15. The street lamp as claimed in claim 14, wherein the lampshade comprises a first ring-shaped loading surface facing to the opening, the lamp mounting plate is attached to the first loading surface.

16. The street lamp as claimed in claim 9, wherein the lampshade comprises a ring-shaped loading surface facing the opening, the lens mounting plate is attached to the second loading surface.

17. The street lamp as claimed in claim 9, wherein the filter film is formed on the plurality of lenses.

* * * * *